United States Patent [19]

Melton

[11] 3,981,596

[45] Sept. 21, 1976

[54] FLOOR FINISH APPLICATOR

[75] Inventor: Joseph E. Melton, Grand Rapids, Mich.

[73] Assignee: Melton Systems, Inc., Grand Rapids, Mich.

[22] Filed: June 30, 1975

[21] Appl. No.: 591,850

Related U.S. Application Data

[63] Continuation-in-part of Ser. No. 432,098, Jan. 9, 1974, abandoned.

[52] U.S. Cl. ..... 401/48; 15/98; 401/139

[51] Int. Cl.[2] ..... A46B 11/02

[58] Field of Search..... 15/48, 49 R, 49 C, 49 RB, 15/50 R, 98, 144 B, 145, 229 BP; 401/48, 137, 139

[56] References Cited

UNITED STATES PATENTS

| | | | |
|---|---|---|---|
| 1,020,125 | 3/1912 | Butterworth | 15/50 R |
| 1,584,687 | 5/1926 | Ault | 15/50 R |
| 1,910,325 | 5/1933 | Finnell | 15/50 R |
| 2,074,623 | 3/1937 | Schroth | 15/50 R |
| 2,168,121 | 8/1939 | French | 15/144 B |
| 2,272,983 | 2/1942 | Payne | 15/49 C |
| 2,425,852 | 8/1947 | Young | 15/145 |
| 2,979,756 | 4/1961 | Wallis | 401/48 |
| 3,283,675 | 11/1966 | Gifford | 15/50 R |
| 3,377,639 | 4/1968 | Stevenson | 15/98 |
| 3,457,015 | 7/1969 | Taber | 15/229 BP |
| 3,678,533 | 7/1972 | Cravits | 15/50 |

*Primary Examiner*—Stanley N. Gilreath
*Assistant Examiner*—Robert Pous
*Attorney, Agent, or Firm*—McGarry & Waters

[57] ABSTRACT

A floor finish applicator comprises a frame mounted on wheels for movement in any selected direction, a liquid finish storage tank mounted on the frame, a finish applying mechanism adapted to deliver finish from the outlet of the storage tank to the floor, and a finish spreader adapted to spread the finish out into a smooth even finish after it has been applied to the floor. The finish spreader is mounted behind the frame and is movable in a transverse direction with respect to the direction of movement of the frame. The finish spreader is resiliently biased to remain in a predetermined position but is mechanically movable in either transverse direction. A roller is provided at one or both ends of the spreader in order to provide a rolling contact between the finish spreader and the wall of a room being finished. The applicator may be used to apply any type of liquid to a floor, including waxes, varnishes, cleaners or the like.

25 Claims, 13 Drawing Figures

FLOOR FINISH APPLICATOR

CROSS REFERENCE TO RELATED APPLICATION

This application is a continuation-in-part of applicant's co-pending application Ser. No. 432,098, filed Jan. 9, 1974, now abandoned.

BACKGROUND OF THE INVENTION

1. Field of the Invention

This invention relates to a floor finish applicator and more particularly to an automatic floor finish applicator for applying a liquid wax or other finish to a floor.

2. Description of the Prior Art

Automatic apparatus for scrubbing and vacuuming floors are known, but heretofore the application of a liquid wax or other such finish to a floor has been accomplished principally by hand. For a large shopping mall, such an operation could take as much as 80 hours of time for a single individual to apply a coat of wax to the floor. One method of doing this job by hand is to have one individual spreading or spraying the wax on the floor and have another individual following behind the first individual walking through the wax and dragging a mop or other type of wax spreader through the wet wax in order to distribute the wax on the floor evenly and smoothly. This is a long, inefficient, and sometimes not very satisfactory procedure for applying a finish to a floor.

One type of device heretofore designed for applying a wax finish to a floor comprises a frame that holds a container for liquid wax and a feed line that feeds the wax by gravity to an outlet nozzle positioned behind the frame. The outlet nozzle sprays the wax on the floor, and a mop mounted behind the frame is pulled through the wet wax as the frame is rolled across the floor. Problems are encountered with this apparatus, becuase the pressure with which the finish is applied to the floor is directly related to the amount of liquid in the tank, since the tank is operated on a gravity basis. Also, it is difficult to apply a wax finish in a corner of a room, because the mop is rigidly attached to the back of the frame and the frame must be swiveled around several times before the mop can be inserted in the corner of the room. This procedure is time consuming and results in substantial overlapping of wax and a generally sloppy job in corners.

Another deficiency with this type of apparatus is that it is merely a device for applying a wax finish and is not sufficiently adjustable or adaptable to be used in applying other types of finishes to floors. Indeed, it lacks even the necessary adjustment to achieve variation in the manner on which the wax finish is applied to the floor, such as by varying the thickness of the wax coating or the manner in which the wax is sprayed on the floor.

SUMMARY OF THE INVENTION

The present invention provides a floor finish applicator that may be operated by a single individual in order to apply a wide variety of finishes to any type of floor simply by pulling the floor finish applicator across the floor to be finished. A corner of a room may be finished simply by pulling the applicator in a circular path past the corner, during which time the applicator itself will automatically apply a finish right into the corner without any repetitious movement of the applicator. With the apparatus of the present invention a waxing operation heretofore taking 80 hours of hard work can be accomplished with little effort in about 3 hours.

A floor finish applicator constructed in accordance with the present invention comprises a frame adapted for movement along the floor in any selected direction; a liquid finish storage tank mounted on the frame; a liquid finish applying mechanism adapted to receive finish from the outlet of the storage tank and apply finish to the floor behind the frame in a predetermined manner; and a transversely movable finish spreader connected to the back of the frame and adapted to spread the finish out into a smooth, even finish as the frame is moved along the floor.

The present invention, the finish spreader is mounted behind the frame with respect to the direction of movement of the frame as finish is applied to the floor, and the spreader runs transversely across the frame with respect to this direction of movement.

The spreader is movable in either transverse direction with respect to the frame and is resiliently biased to remain in one predetermined position. Preferably, the spreader includes a transverse frame and a removable mop mounted on the underside of the frame.

It is an important feature of the present invention that the finish spreader is movable in a transverse direction with respect to the frame as the frame and the finish spreader are moved across the floor. This permits the finish spreader to be moved into the corner of the room as the finish applicator moves around the room, thus obviating the necessity to move the finish applicator back and forth in order to fit the finish spreader into the corner.

Since the finish spreader is movable transversely, the finish applying mechanism is mounted so as to apply finish on the floor in the path of the finish spreader, regardless of the position of the spreader with respect to the frame.

In one aspect of the present invention, the frame of the finish spreader comprises a perforated tray, and finish is applied to the floor by delivering finish to the perforated tray. The finish drips through the tray on the mop and is applied to the floor by the mop itself. In another aspect of the present invention the finish is sprayed on the floor in front of the finish spreader by means of spray nozzles mounted on the finish spreader. Check valves can be incorporated in the spray nozzles to prevent dripping.

Although it might be possible to employ a gravity feed system for applying liquid finish to the floor, at least where finish is dripped on the mop through a perforated tray, an important feature of the present invention is that the liquid finish is applied to the floor by means of a pressure feed, preferably an air pressure feed. Further, this pressure is adjustable in order to permit variation in the thickness of the finish or to accommodate different types of finish. By providing a forced feed of liquid to the floor, the above noted deficiencies with a gravity feed mechanism are obviated, and wide variation is permitted in the nature and thickness of finish that may be applied to the floor. A pressure feed system is particularly desirable when finish is sprayed on the floor.

In the floor finish applicator of the present invention, a mechanical linkage attached to the finish spreader is employed in order to control the transverse alignment of the finish spreader with respect to the frame, and a resilient biasing mechanism is employed in order to resiliently bias or urge the finish spreader to remain in one predetermined transverse position. The mechanical linkage interconnecting the finish spreader and the frame preferably is in the form of a parallelogram type of linkage, so the finish spreader remains in transverse alignment with respect to the frame as it moves back and forth across the frame.

In a preferred form of the present invention, the finish spreader is biased to remain centered with respect to the frame, and transverse movement of the finish spreader is accomplished by pivoting the frame in a sideways direction. In another aspect of the present invention the finish spreader is resiliently urged toward one transverse direction, and mechanical linkage is provided for manually moving the finish spreader in the opposite transverse direction.

A roller is mounted on one or both ends of the finish spreader so as to provide a non-frictional contact between the finish spreader and the wall. The position of the roller with respect to the finish spreader may be made adjustable so that, if desirable, the application of finish to the portion of the floor adjacent the wall can be avoided. This is desirable in order to avoid wax build-up in certain instances.

Another feature of the present invention is that the pressure of the finish spreading means on the floor is uniform and desirably adjustable. In one aspect of the present invention, the finish spreader is pivotable in a vertical plane with respect to the frame so that the finish spreader rides evenly on the floor even when the position of the frame is varied. A pressure applying mechanism in the form of a spring may be employed to increase the downward pressure on the finish spreader and provide a means for varying such pressure.

By providing for adjustment of the pressure on the finish spreader, additional control over the distribution and thickness of the finish may be achieved. For a wax application, for example, the pressure on the finish spreader desirably is adjusted so that it exerts a force of 2–5 pounds on the finish spreader.

In another aspect of the present invention the frame is mounted on a two wheel axle, and the applicator is supported in a horizontal position by a third wheel in front of the other two wheels. The third wheel incorporates the adjustable pressure mechanism by means of a compression spring biasing mechanism between the third wheel and the frame, with the biasing mechanism being adjustable by means of a threaded adjustment mechanism that controls the downward extension of the third wheel and the force on the finish spreader.

Application of finish to the floor is controlled by a manual or solenoid-operated shut-off valve connected between the finish outlet and the outlet of the liquid finish storage tank. This valve may be set for continuous operation or for intermittent operation only when a button or lever is depressed. This provides maximum utilization of the feed mechanism in order to further control the manner in which the finish is applied to the floor.

These and other advantages and features of the present invention will hereinafter appear, and for purposes of illustration, but not of limitation, a preferred embodiment of the present invention is described in detail below.

DETAILED DESCRIPTION OF PREFERRED EMBODIMENTS

Figure 1:
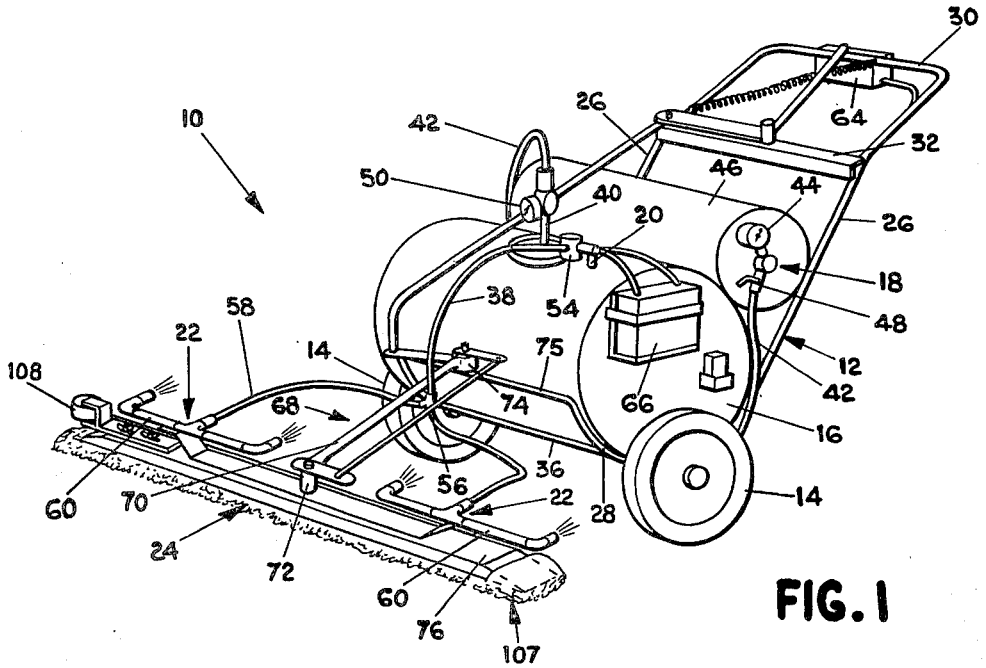
FIG. 1 is a perspective view of a floor finish applicator embodying the principles of the present invention.
Figure 2:
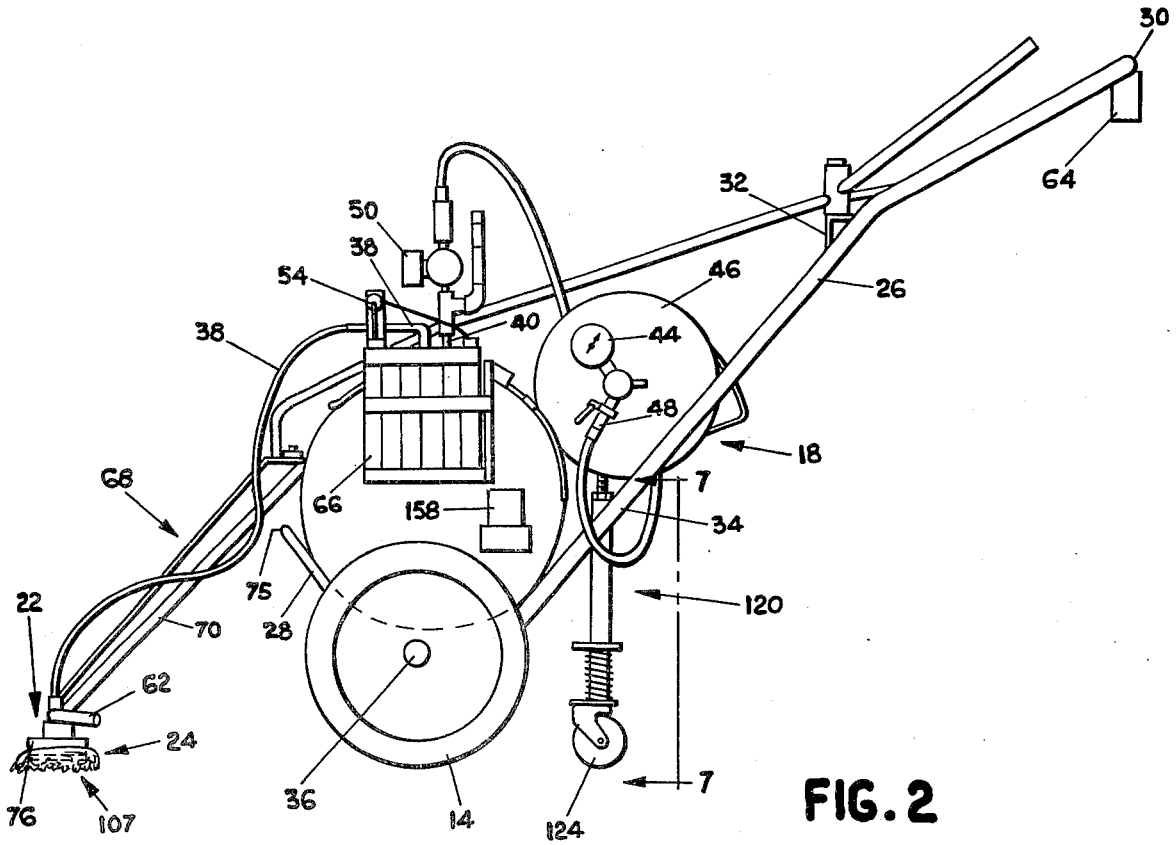
FIG. 2 is a side view of the floor finish applicator of the present invention.
Figure 4:
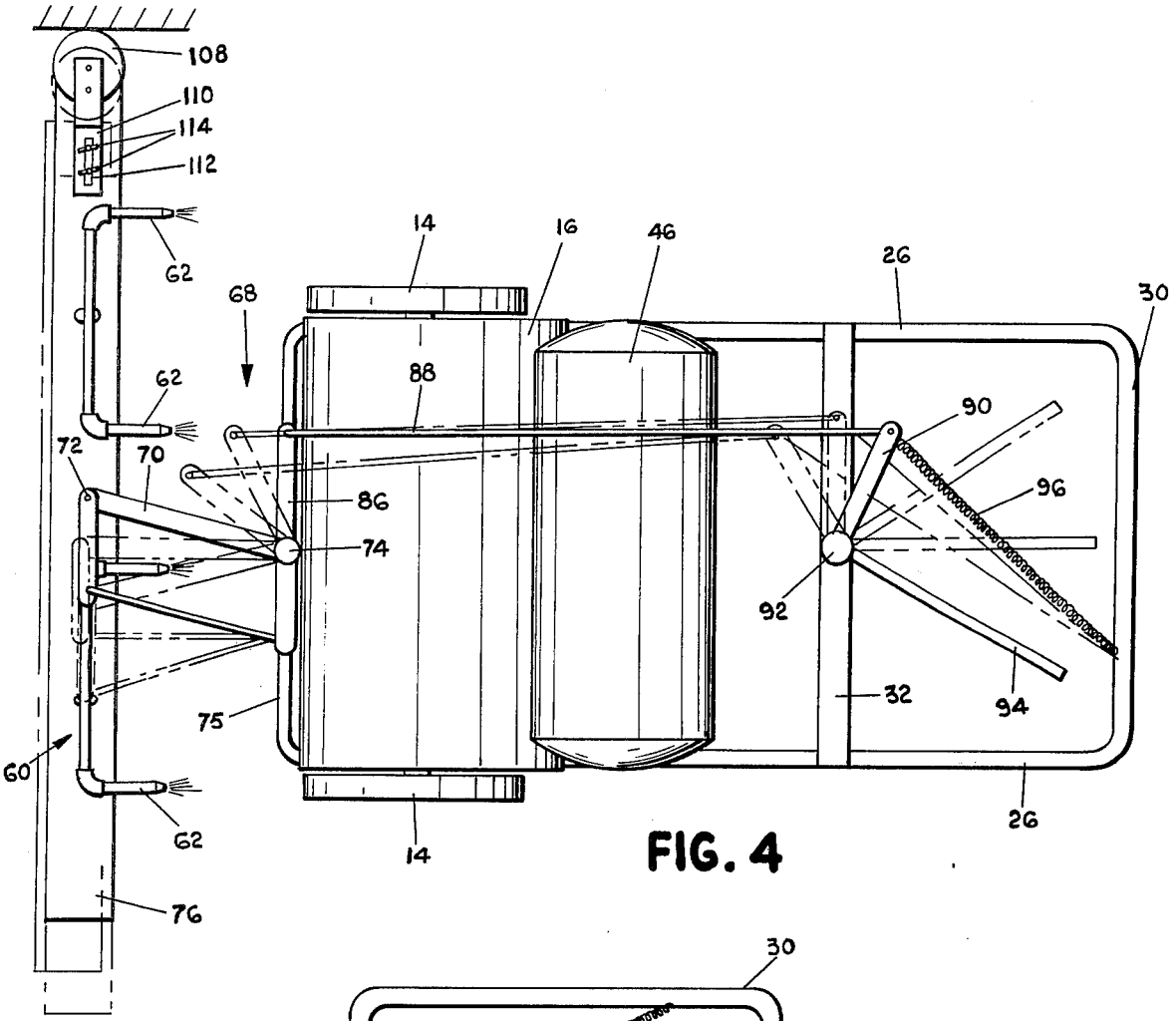
FIG. 4 is a schematic top view of the floor finish applicator of the present inventor, showing only the finish spreader and the mechanical linkage by which the finish spreader is moved transversely back and forth with respect to the direction of the movement of the frame.
Figure 3:
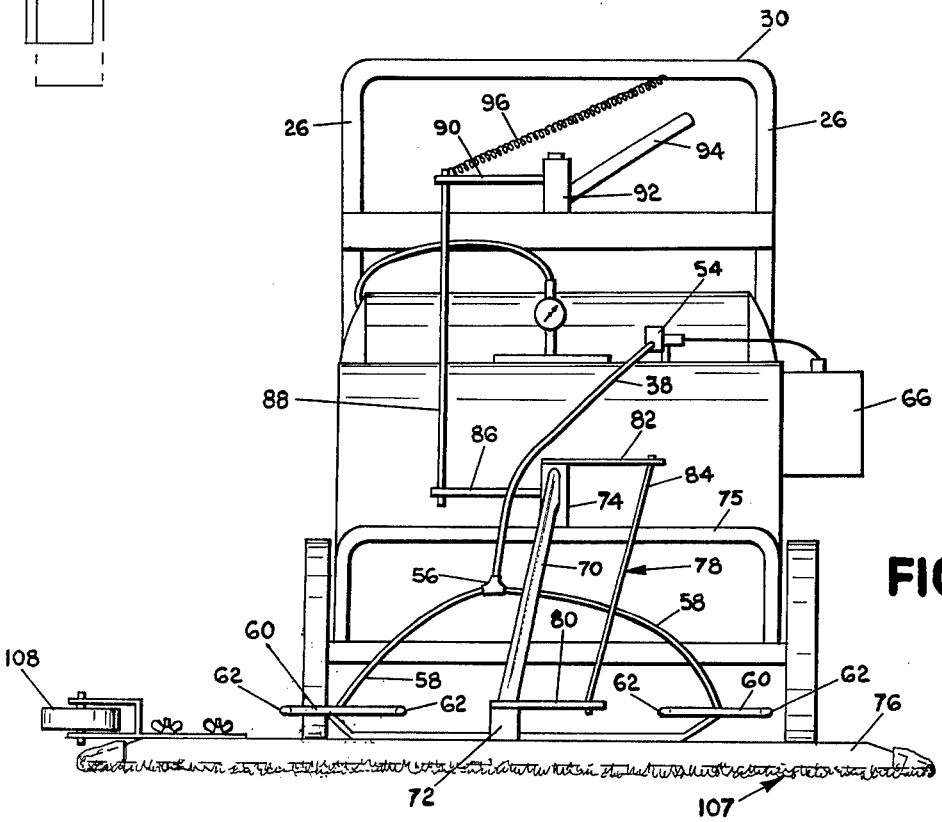
FIG.3 is a front view of the floor finish applicator of the present invention, showing the floor finish applicator in position to apply finish to a section of floor adjacent the wall.

A first illustrative embodiment of a floor finish applicator 10 employing the features of the present invention is shown in FIGS. 1–7 of the attached drawings.

The basic components of floor finish applicator 10 are a frame 12 mounted on wheels 14 for movement in any selected direction along the floor; a liquid finish storage tank 16 mounted on the frame; a pressure feed mechanism 18 adapted to apply pressure to the liquid finish storage tank and deliver liquid finish from an outlet 20 of the storage tank; a selectively operable spray mechanism 22 adapted to receive finish from the outlet of the storage tank and spray the finish on the floor in a predetermined manner; and a finish spreader 24 connected to the frame and adapted to spread the finish out into a smooth even finish after it has been applied to the floor by the sprayer as the frame is moved along the floor in its selected direction.

Frame 12 comprises a pair of parallel side rails 26 extending from curved lower ends 28 to an upper end comprising a transverse handle 30 extending between the rails. Transverse reinforcing braces 32 and 34 extend between the rails. An axle 36 extends between wheels 14 underneath storage tank 16.

Storage tank 16 rests on curved lower ends 28 of the side rails 26 and is fastened to the frame by welding or some other conventional manner. Storage tank 16 comprises a closed pressurizable vessel having an inlet and an outlet and being adapted to hold liquid finish therein. In the exemplary embodiment of the present invention shown in the drawings, the inlet and outlet are the same opening 20 in the storage tank, but no particular design of storage tank is essential, and it would be possible to have separate inlet and outlet openings. Liquid finish storage tank 16 may be of any convenient size or configuration A pressurizable vessel having a liquid capacity of 7½ gallons has been found to be satisfactory.

An outlet conduit 38 extends from the bottom of the storage tank upwardly through outlet opening 20 and onward to spray mechanism 22. Outlet conduit 38 extends all the way down to the bottom of the tank so that air pressure injected into the tank will force liquid through outlet conduit 38 until the tank is completely empty of liquid.

Liquid finish storage tank 16 is also provided with a gas pressure inlet 40 for delivering liquid finish from the storage tank through outlet conduit 38. In the preferred practice of the present invention, air pressure is used to pressurize the tank, but any type of compressed gas would be satisfactory. Air pressure is preferred because an air tank can be recharged conveniently at no cost at any gas station simply by using the tire pumps available at such stations.

The pressure mechanism 18 of the present invention comprises an air tank 46, which is connected to pressure inlet 40 of the liquid storage tank by means of a conduit 42. Conduit 42 runs from an outlet 52 to the air tank to pressure inlet 40 of the liquid finish storage tank and includes in series a pressure gage 44, an adjustable shut off valve 48, and another pressure gage 50. Pressure gage 46 measures the pressure in the air tank, while pressure gage 50 measures the pressure in the liquid storage tank. Air pressure shut off valve 48 is adjustable so that the pressure on the liquid in the liquid storage tank can be varied in order to regulate the amount of liquid sprayed onto the floor. Similarly, the valve can be completely shut off when the machine is not in use or when the liquid becomes completely expelled from the liquid storage tank.

Air tank 46 is mounted on frame 12 between rails 26 and comprises any type of convenient gas pressure tank. A 200 pound air tank has been found to be completely satisfactory for use in the present invention, and the pressure available in such a tank by filling the tank with a conventional air hose at a gasoline service station is sufficient to apply about six 55 gallon drums of wax onto the floor between tank refills. Under ordinary circumstances, this is enough air pressure to operate the applicator for about 6 months between air tank refills.

In the operation of the present invention, the sprayer system is adapted to operate on 5–10 psi air pressure in the liquid storage tank. When the adjustable air pressure valve 48 is set at about 10 psi, finish is sprayed on the floor at a rate of about 1,000 square feet per gallon of finish, and when the pressure is set at 5 psi, the finish is applied to the floor at about 2,000 square feet per gallon of finish. Other parameters, of course, would be possible depending upon the type of nozzles used, the type of supply lines used, the type of finish applied and the speed at which the application is moved along the floor.

Figure 6:
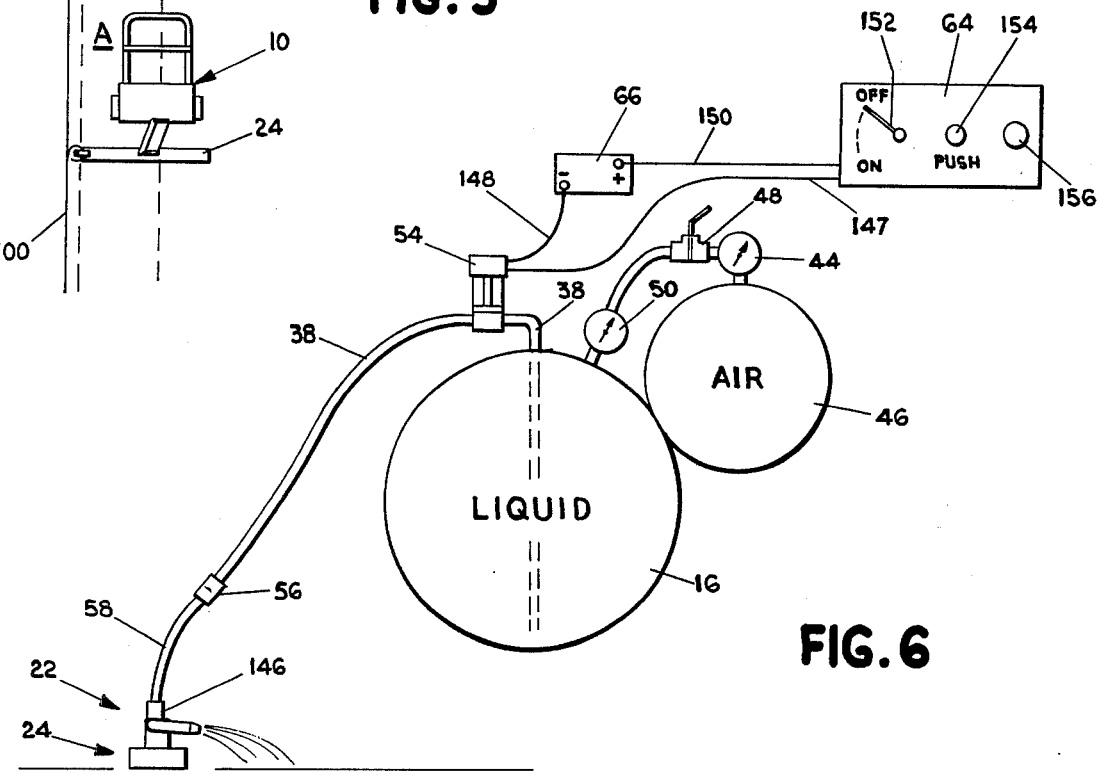
FIG. 6 is a schematic drawing showing the hydraulic and electrical system of the present invention.

Outlet conduit 38 leading from outlet 20 of the liquid storage tank passes through a solenoid operated shut-off valve 54 and then on to a T-connection 56. A pair of conduits 58 lead away from T-connection 56 to a pair of sprayer heads 60 mounted on top of finish spreader 24. As shown in FIG. 6, each spayer head 60 comprises a pair of nozzles 62 which are positioned so as to spray liquid finish directly in front of the finish spreader and behind the rolling wheels of the frame as the frame is pulled along the floor. Thus, the only thing that passes through the liquid wax after it is sprayed on the floor is the finish spreader, and the operator pulling the applicator never has to walk through wet wax.

Nozzle 62 can be any type of readily available spray nozzle, with the size of the orifice depending upon the nature and viscosity of the liquid being applied. For the application of wax, a nozzle known commonly as a "5 pound nozzle" and having a flat spray adapted to spray liquid wax through a 9 inch width when placed 5 inches from the floor operates satisfactorily when the nozzles are spaced evenly apart on a 36 inch finish spreader. One important feature of the nozzle of the present invention is that each nozzle is provided with a liquid flow check valve in order to prevent liquid from dripping from the valve after the pressure feed mechanism has been cut off.

Solenoid operated shut off valve 54 is remotely controlled by means of a switch 64 mounted on handle 30 of the frame in a convenient location for remote control operation by an individual operating the floor finish applicator. Solenoid 54 is conventional solenoid actuated shut off valve and is driven by means of a 12 volt battery 66. It should be recognized that it is not necessary that the shut off valve be solenoid operated but could be a manually operated shut off valve.

Finish spreader 24 is mounted behind the frame so that it trails the frame and is dragged along the floor as the frame is pulled along the floor. The finish spreader is pivotably attached to the frame for rotation about a vertical axis by means of a mechanical linkage 68. The principal member of the mechanical linkage 68 is a trailing arm 70 extending between vertical pivot members 72 at the center of the finish spreader and 74 at the center of the frame. The vertical pivot members may be vertical studs mounted on the finish spreader and the frame, respectively, with the trailing arm having vertical openings therethrough that fit over the studs and permit rotation about the vertical studs. Pivot member 74 attached to the frame may be mounted on the frame itself by means of a cross brace 75 extending across the storage tank, or, alternatively, it could be mounted directly on the storage tank or some other element fixed directly or indirectly to the frame. For purposes of convenience herein, the trailing arm is referred to as being pivotably attached to the frame, regardless whether attachment is directly to the frame or indirectly to the frame by attachment to the liquid storage tank or the like.

Floor finish spreader 24 comprises an elongated spreader frame 76 that extends transversely to the direction of movement of the floor finish applicator. Spreader frame 76 may be formed of any conventional material, with a simple wood frame being satisfactory for purposes of the present invention.

As is evident from the pivotal mountings at each end of trailer arm 70, finish spreader 24 is movable in a generally transverse direction with respect to the direction of movement of the floor finish applicator. A parallelogram linkage 78 connected between pivot members 72 and 74 maintains proper transverse alignment of the floor finish spreader as it goes back and forth in a transverse direction. This parallelogram linkage includes arms 80 and 82 that are fixed to pivot members 72 and 74, respectively, and extend in the same fixed transverse position. A rod 84 extends between outer ends of rods 80 and 82 and runs parallel with trailing arm 70. Arms 80 and 82 and trailing arm 70 and rod 84 thus form a parallelogram and hold finish spreader 24 in a proper transverse position as it moves back and forth with respect to the floor finish applicator.

It should be noted that with the linkage of the present invention, the movement of the finish spreader also causes the spreader to move forward somewhat in a circular path as it pivots about pivot member 74. This forward movement is not critical to the present invention and could be replaced by mechanical linkage that provides for a pure transverse movement.

Movement of the floor finish applicator in a transverse direction is controlled by a mechanical linkage connected to trailing arm 70 at pivot point 74. This mechanical linkage includes an arm 86 attached to the trailing arm for rotation therewith, with the other end of arm 86 being pivotally attached to a rod 88 that extends toward the front of the applicator. The front end of rod 88 is connected to an outer end of an arm 90. The inner end of arm 90 is mounted for rotation about a vertical axis about a pivot member 92 attached to cross member 32. A lever handle 94 is attached at the inner end of arm 90 for rotation therewith, and the outer end of the lever handle providing a hand grip for manually moving the mechanical linkage. A resilient biasing means in the form of a tension spring 96 extends between handle 30 of the floor finish applicator and the outer end of arm 90. Resilient biasing means 96 urges arm 90 to pivot in a clockwise direction (FIG. 4 orientation), and this force resiliently urges the finish spreader to move in a first transverse direction (i.e., toward the left according to FIG. 4 orientation). Lever handle 94, on the other hand, is manually operable to move the floor finish spreader in either transverse direction, including the transverse direction opposite the direction urged by tension spring 96.

Figure 5:
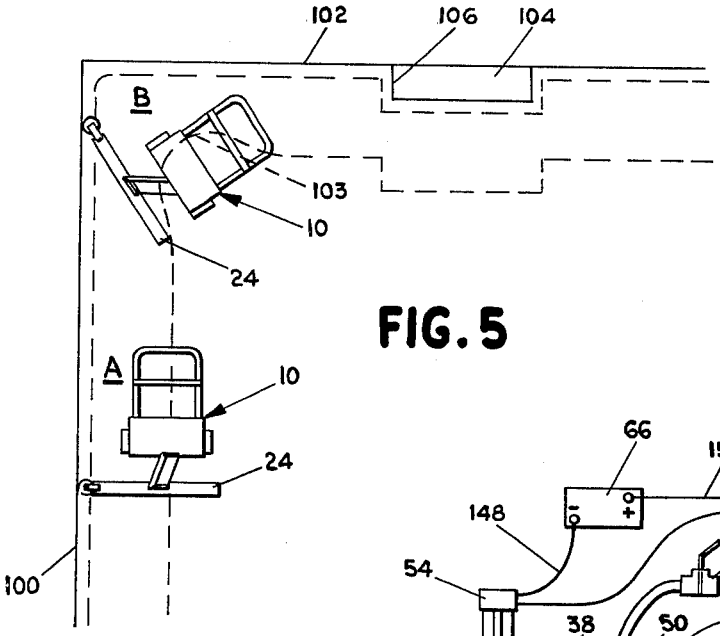
FIG. 5 is a pictorial view showing the manner in which the floor finish applicator of the present invention is employed to apply a liquid finish around the outer perimeter of a room.

The purpose for providing for transverse movement of the floor finish spreader and providing resilient biasing means to urge the spreader in one direction and a lever means for manually moving the floor finish spreader in either direction is depicted schematically in FIG. 5, where a floor finish applicator is shown in the manner in which it would follow the path around the outer perimeter of a room. At position A, the floor finish applicator is moving laterally along wall 100 toward the corner of the room in a clockwise direction. The spring tension of resilient biasing means 96 is adjusted to urge the floor finish spreader against the wall with a pressure of 2–5 pounds, and the applicator is offset somewhat from the track of the floor finish spreader. As the spreader approaches the corner of the room formed by walls 100 and 102, the applicator is moved in the generally circular path 103, and as the applicator is turned to the general position B shown in the drawings, the resilient biasing means moves the floor finish spreader and spray nozzles mounted thereon directly into the corner of the room, thus providing an even and smooth finish in the corner of the room even though the floor finish applicator is moved in a generally circular path through the corner. If the floor finish spreader and spray nozzles were mounted in a fixed position with respect to the applicator, it would not be possible to apply a finish in the corner of the room by a single sweep past the corner, and it would be necessary to move the applicator back and forth several times in order to jockey the corner of the spreader into the general proximity of the corner of the room. In doing this, there would of course be a substantial overlap of finish in the corner of the room. This would be objectionable when the finish being applied is a liquid wax and would be completely unsatisfactory when the finish being applied is varnish or other type of permanent floor finish, where finish thickness is even more critical. Further, it would take substantially more time to finish the corner of the room if the floor finish applicator were not transversely movable with respect to the frame.

It would be possible to dispense with the spring biasing feature of the mechanical linkage and move the finish spreader into the corner directly by means of the lever handle. However, the spring biasing means provides a convenient and automatic method for accomplishing this result while both hands are maintained on the handle of the floor finish applicator as the applicator is pulled along its path.

The importance of the lever handle manual movement of the finish spreader in a direction opposite to the direction in which the spring mechanism urges the spreader is evident from the path that the applicator has to follow in order to get around an obstruction such as obstruction 104 shown in FIG. 5. When the floor finish applicator reaches surface 106 of obstruction 104, the outer end of the finish spreader will come into direct contact with the surface. In order to move the spreader around the obstruction, lever handle 96 is moved in a counterclockwise (FIG. 4 orientation) direction and this moves the finish spreader around obstruction 104. The lever is then released and the resilient biasing mechanism urges the outer end of the finish spreader back into contact with the wall for the remainder of the path along the wall.

After the first path around the outer perimeter of the room has been completed and the section of floor immediately adjacent the wall has been finished, the remaining portions of the floor may be finished in a similar manner, with the floor finish spreader overlapping slightly the path of the previous application as a new section of floor is finished. By having the floor spreader offset from the track of the floor finish spreader, it is possible to overlap slightly the previous path of the floor finish spreader while the applicator track remains on unfinished floor. The lever handle and mechanical linkage may be set up so that the floor finish spreader may be offset on the right side of the finish applicator (FIG. 3 orientation) as well as on the left side, so that a counterclockwise path may be followed around the room in any appropriate situation. As indicated above, it is an important feature of the present invention that sprayer 60 be mounted on top of the frame, so that the liquid finish will always be sprayed immediately in front of the finish spreader regardless of the transverse position of the finish spreader.

The actual spreading of the finish is accomplished by a mop 107 formed of cotton, nylon or rayon, or similar material, and mounted on the frame 76 in a conventional manner. Any type of applicator would work with the present invention, including a lambs wool applicator or any other type of material that would effect the spreading out and smooth and even distribution of the finish sprayed on the floor. A conventional 36-inch by 4-inch "Tu-way" brand cotton dust mop is satisfactory for applying a wax finish to a floor.

The outer end of finish spreader 24 (i.e., the end facing the direction in which the spring mechanism urges the spreader to move) is provided with a roller 108 that is pivotably mounted about a vertical axis. The roller is mounted on a mounting plate 110 that is slidable or otherwise adjustable for movement in a longitudinal direction away from the end of the spreader. In the embodiment shown plate 110 is provided with a slotted opening 112 and is held by a pair of wing nut fasteners 114 spaced apart in longitude alignment on the end of finish spreader 24.

The purpose of roller 108 is to provide a rolling contact between the end of finish spreader and the wall of the room as the finish applicator goes about the path shown in FIG. 5. The roller position is adjustable on the end of finish spreader in order to provide a means by which the operator can avoid applying a finish to the section of floor immediately adjacent the wall. It is often desirable in waxing a floor to avoid re-waxing the portion of the floor adjacent the wall so as to avoid wax buildup where there is substantially no foot traffic. On the other hand, when a permanent finish such as a varnish or sealer is applied to the floor, it might be necessary to completely remove the wheel so that the finish can be applied right up to the edge of the wall.

Another important feature of the present invention is that the pressure with which the finish spreader is applied to the floor is adjustable by means of a pressure adjustment means 120. The pressure adjustment means could be incorporated into the mechanical linkage or into the finish spreader itself, but in the apparatus of the present invention this function is conveniently incorporated into the mounting mechanism for a third wheel 124, which is mounted at the middle of cross member 34 behind wheels 14. Wheel 124 provides a three point balance for the frame and maintains the frame in a generally upright position. With the frame in an upright position, the wheel causes the mop to be in contact with the ground with a certain amount of force. This force is adjustable by means of a resilient biasing means 126 that urges the wheel downwardly onto the floor with a certain predetermined pressure. This pressure urges the frame to pivot about axle 36 in a counterclockwise direction (FIG. 2 orientation), and this movement urges mop 107 into contact with the floor with a force that is equal and opposite to the force exerted by spring 126.

Figure 7:
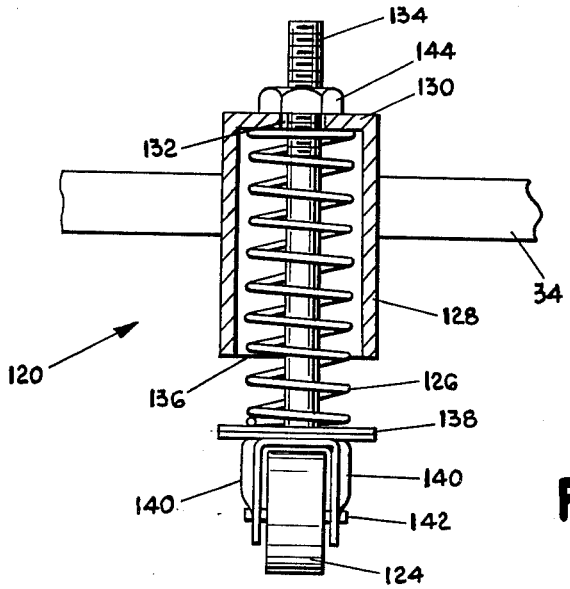
FIG. 7 is a broken sectional view taken along line 7—7 of FIG. 2.

As shown in detail in FIG. 7, a sleeve 128 is mounted in vertical alignment on cross member 34. Sleeve 128 comprises a capped upper end 130 having a central opening 132 therein and an open lower end 136. Spring 126 is a compression spring that fits within the sleeve and bears on end 130 at the top of the spring and on a plate 138 below the spring. A pair of spaced plates 140 extend downwardly from plate 138, and wheel 124 is rotatably mounted on an axle 142 that extends between the lower ends of supports 140. A threaded rod 134 extends upwardly from plate 138 through the upper end of sleeve 128 and is retained on the sleeve by means of a nut 144 threaded onto the upper end of rod 134. By tightening the nut on the threaded rod the distance between the wheel and the frame is shortened, thus relieving the pressure on the mop. By loosensing the nut so as to increase the distancce between the wheel and the top of the sleeve, the pressure on the mop is increased. For a wax finish, this lost motion spring interconnection between the wheel and the frame is adjusted to apply a pressure of 2–5 pounds on the mop.

The electrical and hydraulic circuitry of the present invention are shown schematically in FIG. 6. The hydraulic circuitry has for the most part been described previously and will not be described again, except to note that a filter 146 is inserted in line 58 at the inlet to each nozzle. This filter prevents contaminants and impurities from clogging the outlet nozzles.

In the electrical system, solenoid 54 is operated by batter 66 (which is a conventional 12 volt battery) and is controlled by appropriate switches in control panel 64. A lead 147 connects solenoid 54 to control panel 64, and a lead 148 connects the battery to the solenoid. Another lead 150 connects the battery to the control panel. The control panel includes "off-on" switch 152 for continuous operation of the sprayer and a button 154 for intermittent operation of the sprayer. The off-on switch is turned off and the button is depressed in order to apply floor finish on an intermittent basis. This system provides further means for controlling the nature and thickness of the finish applied to the floor. A light 156 is employed to indicate when the battery is connected.

Another desirable feature of the preferred practice of the present invention is that an electrical battery charger 158 is included in a bracket on the side of the storage tank. This battery charger can be plugged in a wall and connected to the battery when the finish applicator is not in use so that the battery will always have a fresh charge whenever the floor finish applicator is used.

Another embodiment of the present invention is shown in FIGS. 8–13. These drawings emphasize the differences in the second embodiment from the first embodiment, and some of the features common to both embodiments are, for purpose of brevity, not shown in these drawings.

In this embodiment, a frame or housing 200 is mounted on spaced parallel wheels 204, which are connected by an axle 206. A handle 208 is employed for pulling the applicator across the floor. A transversely movable finish spreader 210 is dragged behind the housing or frame 200 by means of a parallelogram linkage 212, which is mounted on the underside of the housing.

In this embodiment a liquid finish storage tank is mounted in housing 200 and a pneumatic pressure feed mechanism is employed for dispensing liquid finish at a predetermined pressure. These items are substantially the same as in the previous embodiment and are not shown herein.

One difference in this embodiment is the manner in which the finish spreading mechanism is mounted to the frame of the floor finish applicator. Parallelogram linkage 212 comprises a pair of parallel arms 214 formed of downwardly facing channel material. Arms 214 are pivotably mounted to finish spreader 210 at the front ends thereof by means of studs 211 that extend upwardly from the finish spreader. These arms extend rearwardly and are pivotably mounted to the housing on the underside thereof. A hollow mounting block 216 extends downwardly from housing 200, with arms 214 being pivotably mounted on the underside of the mounting block on opposite sides thereof. A caster 218 is also mounted on the underside of the mounting block at a position between arms 214.

Caster 218 is pivotably about a vertical axis so as to permit the frame to be turned or pivoted about a vertical axis.

Figure 11:
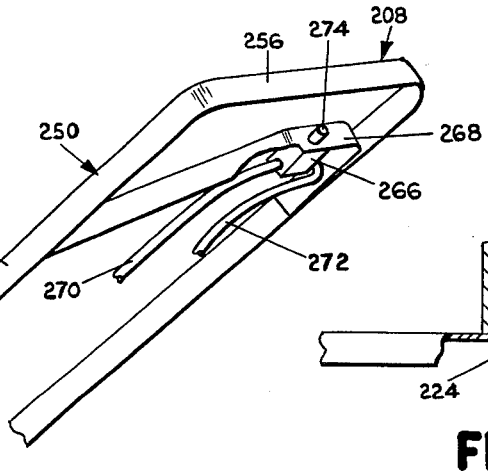
FIG. 11 is a broken and partially cross sectional view showing the manner in which the finish spreader of the FIG. 8 embodiment is attached to the underside of the applicator.
Figure 11:
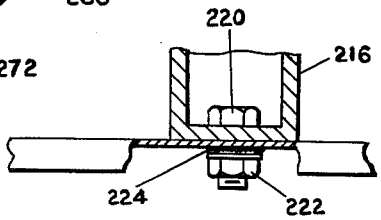

Arms 214 are mounted to mounting block 216 in the manner shown in FIG. 11. A bolt 220 extends downwardly from the interior of mounting block 16 through an opening in each arm 214 to a nut 222 threaded on the lower end thereof. A wave washer 224 is included between nut 222 and arm 214.

When mounted in this manner, arms 214 are pivotable to some extent in a vertical direction with respect to frame 200. This insures that the finish spreader will rest against the floor while the finish spreader is moved across the floor, even though there may be some variation in the position of frame 200 itself. In particular, frame 200 may be pivoted somewhat in a vertical direction without causing extra pressure on the mop or without raising the mop off the floor.

The pivotable movement of arms 214 with respect to frame 200 is limited, however, so that after the frame has been pivoted away from the finish spreader a predetermined distance, the frame causes the finish spreader to be lifted off the floor. This is a desirable feature, in that it makes it possible to lift the finish spreader off the floor after a floor finish application has been completed.

The rear ends of arms 214 are attached by resilient biasing mechanisms 226 in the form of coil springs to a cross brace 228 of frame 200. Springs 226 urge arms 214 to remain centered so that the finish spreader remains centered with respect to the path of the floor finish applicator. The finish spreader can be moved out of the path of the floor finish applicator easily, however, by simply pivoting the floor finish applicator on a vertical axis.

Figure 8:
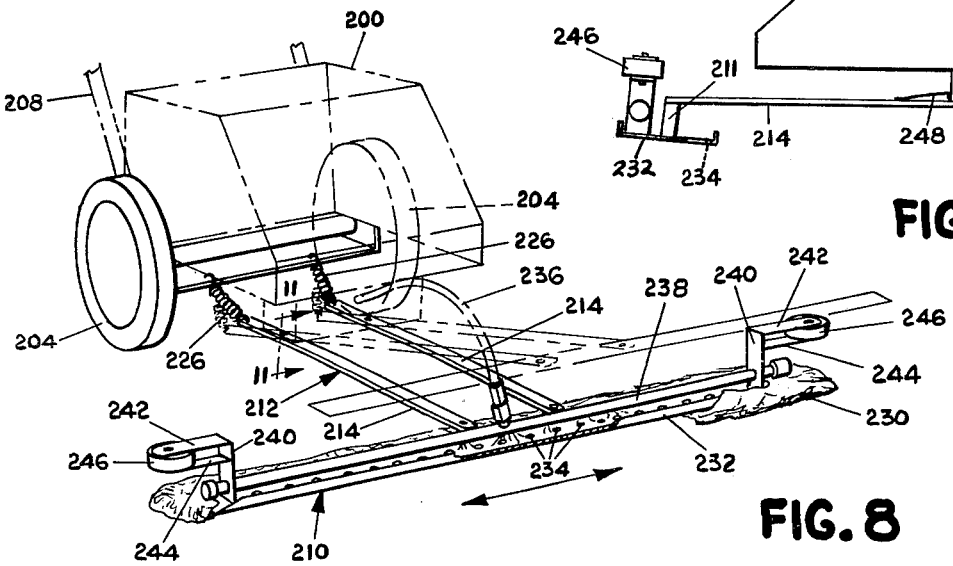
FIG. 8 is a partial, perspective view of a second embodiment of the present invention.

As shown in FIG. 8, finish spreader 210 comprises a mop 230 mounted on the underside of a transverse spreader frame 232. Spreader frame 232 comprises a receptacle or open top tray having a series of perforations or openings 234 at the leading edge of the tray leading to the top side of mop 230. Liquid finish is dispensed on the floor with this apparatus by delivering liquid finish to receptacle 232 and permitting the liquid finish to drop through openings 234 onto the mop. The mop also is perforated to make it sufficiently porous to permit liquid finish to soak through the mop and be dispensed on the floor smoothly and evenly by the mop itself. The tray slopes downwardly toward the openings at an angle of about 5° so that liquid finish flows toward the openings in the tray.

Liquid finish is provided to receptacle 232 by means of a conduit 236 which receives liquid finish from the storage tank and extends to a transverse outlet tube 238 that extends the length of receptacle 232. Outlet tube 238 is perforated, so that liquid finish drips into the receptacle uniformly along its entire length. Outlet tube 238 is mounted above the receptacle 232 by means of brackets 240 extending upwardly from each thereof.

Brackets 240 include outwardly extending upper and lower arms 242 and 244 respectively, and wheels 246 are pivotably mounted between these arms for rotation about a vertical axis. As indicated above, the purpose of wheels 246 is to provide a rolling engagement between the outer end of the finish spreader and any walls or obstructions that the finish spreader may contact.

Figure 9:
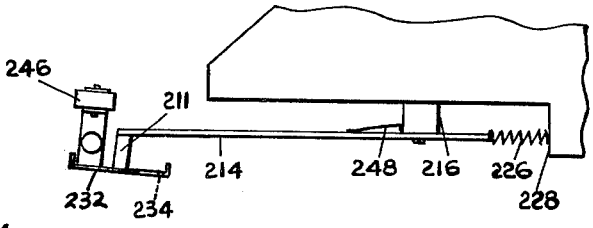
FIG. 9 is a broken side elevational view of the embodiment shown in FIG. 8.

Another feature that may be incorporated into the finish spreading mechanism of the present invention is a resilient biasing device 248 providing additional downward pressure on the finish spreader. As shown in FIG. 9, resilient biasing device 248 comprises a pair of resilient spring mechanisms mounted on mounting block 216 and extending into contact with arms 214 at a position in front of the mounting block. The downward spring pressure provided by resilient biasing device 248 increases the downward pressure on the finish spreader in order to provide variation in the thickness of the finish. Resilient biasing device 248 can be constructed so as to provide an adjustable downward pressure on the finish spreader.

Figure 13:
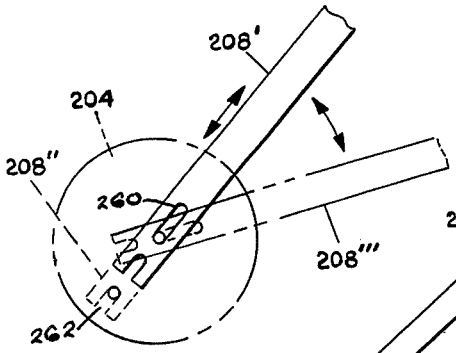
FIG. 13 is a broken side elevational view showing the mechanism by which the handle shown in FIG. 12 is mounted on the frame of the present invention.
Figure 12:
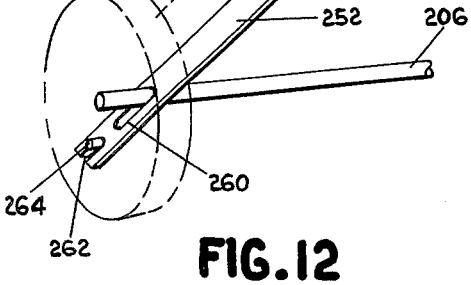
FIG. 12 is a broken perspective view of the handle employed with the FIG. 8 embodiment.
Figure 10:
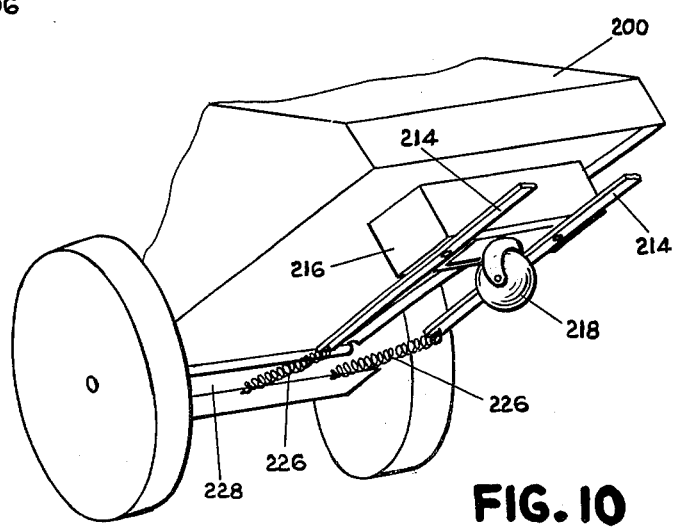
FIG. 10 is a broken perspective view showing the underside of the embodiment shown in FIG. 8.

The construction of handle mechanism 208 is shown in FIGS. 12 and 13. Handle mechanism 208 is a U-shaped member having a tubular upper portion 250 and parallel spaced mounting arms 252 mounted on the lower ends of upper portion 250. Upper portion 250 includes sides 254 and a hand grip 256 extending between the side rails. The lower ends of side rails 254 are mounted on the upper ends of mounting arms 252 by means of a pair of spaced wing nut fasteners 258. Fasteners 258 permit the handle to be collapsed for storage or transportation of the applicator.

Mounting arms 252 each include an elongated opening 260 adjacent the lower end thereof and a groove 262 in the lower end thereof. Axle 206 fits through opening 260 and groove 262 can be positioned so as to fit over a pin 264 which extends outwardly from a fixed position on the frame. The interaction of groove 262 and pin 264 serves as a releasable locking means to hold the handle in a fixed angular position with respect to the frame.

The function and operation of handle 208 is as follows. When it is desired to transport the floor finish applicator across the floor without depositing liquid finish on the floor, handle 208 is first moved to the upper position designated by numeral 208' in FIG. 13, and the handle is then moved downwardly to the position designated by numeral 208'', so that groove 262 fits over pin 264. When in this position, handle 208 is locked in a fixed angular position on frame 200. By pivoting handle 208 downwardly when in its locked position, frame 200 pivots upwardly and this causes the finish spreader to be lifted from the floor.

When it is desired to apply a finish to the floor, handle 208 is lifted so that groove 262 clears pin 264, and the handle is then pivoted downwardly to the position indicated by numeral 208''' in FIG. 13. When in this position, handle 208 is freely pivotable with respect to frame 200, so that the operator can pull the handle from any angular position without affecting the position of the frame or the pressure with which the finish spreader is applied to the floor.

In order to control the amount of finish applied to the floor in this embodiment of the present invention, a simple manually actuated shut-off valve 226 is employed. This valve is mounted on a bracket 268, which extends between sides 250 adjacent hand grip 256. Liquid delivered from the outlet of the liquid finish storage tank travels in a conduit 270 through shut-off valve 266 to another conduit 272, which leads to conduit 236 and the liquid finish applying apparatus. Shut-off valve 266 is resiliently biased toward a closed position, and a simple depressable button 274 is employed to open the valve periodically so as to permit additional liquid finish to flow through the valve to receptacle 232.

It should be understood that the foregoing embodiments are merely exemplary of the preferred practice of the present invention and that various changes and modifications may be made in the arrangement and details of construction of the apparatus disclosed herein without departing from the spirit and scope of the present invention.

The embodiments of the invention in which an exclusive property or privilege is claimed as follows:

1. A floor finish applicator comprising:

frame means adapted for movement along a floor in any selected direction;

liquid finish storage tank means mounted on the frame means, said storage tank means having an inlet and an outlet and being adapted to hold liquid finish therein;

finish spreading means adapted to spread the finish out into a smooth, even finish after it has been applied to the floor, said finish spreading means being mounted in the applicator for transverse movement with respect to the frame as the frame moves in its selected direction in applying finish to the floor, said transverse movement being sufficient to permit the finish spreading means to follow a path along the floor that deviates from the path followed by the frame so as to permit the application of finish around obstacles and corners in a room as the frame is moved past such obstacles and corners; and finish applying means for receiving liquid finish from the outlet of the storage tank and applying liquid finish to the floor in the path of the finish spreading means as the applicator is moved along the floor.

2. A floor finish applicator as claimed in claim 1 wherein the finish spreading means is mounted behind the frame means with respect to the direction of movement of the frame means in applying finish to the floor, said finish spreading means running transversely across the frame means with respect to said direction of movement, said finish spreading means being mounted in the applicator by mechanical linkage means interconnecting the frame means and the finish spreading means, said mechanical linkage means permitting movement of the finish spreading means in either transverse direction with respect to the frame.

3. A floor finish applicator as claimed in claim 1 and further comprising means for manually moving the finish spreading means in a transverse direction.

4. A floor finish applicator as claimed in claim 2 wherein the mechanical linkage means is adapted to maintain transverse alignment of the finish spreading means with respect to the frame means as the finish spreading means moves in said transverse direction.

5. A floor finish applicator according to claim 4 wherein the mechanical linkage means comprises a parallelogram linkage extending between the frame means and the finish spreading means.

6. A floor finish applicator as claimed in claim 1 and further comprising resilient biasing means adapted to resiliently urge the finish spreading means to occupy a predetermined transverse position.

7. A floor finish applicator as claimed in claim 2 and further comprising roller means mounted on at least one of the outer ends of the finish spreading means extending in said transverse directions, said roller means being adapted to engage and roll along a wall as a finish is applied to a section of floor adjacent the wall.

8. A floor finish applicator as claimed in claim 7 wherein the roller means is a roller mounted on a roller plate for rotation about a vertical axis, said roller plate being mounted on the end of the finish spreading means such that the transverse position of the roller plate and roller with respect to the finish spreading means is adjustable.

9. A floor finish applicator as claimed in claim 1 wherein:

the liquid finish storage tank is a closed pressurizable vessel; and the finish applying means include pressure feed means for delivering liquid finish from the storage tank at a predetermined pressure, said finish applying means further including valve means for controlling the flow of liquid finish from the outlet of the storage tank to the finish applying means, the valve means having an open position wherein liquid finish is allowed to flow from the storage tank and a closed position wherein the flow of liquid finish from the storage tank is prevented.

10. A floor finish applicator as claimed in claim 9 wherein the valve means is resiliently biased in its closed position and is manually actuatable to occupy its open position.

11. A floor finish applicator as claimed in claim 9 wherein the valve means is resiliently biased in its closed position and is actuatable to occupy its open position by a manually actuatable electrical solenoid.

12. A floor finish applicator as claimed in claim 9 wherein the finish applying means comprisees a selectively operable spray means for spraying finish on the floor in front of the finish spreading means, said spray means includng nozzle means mounted on the finish spreading means and conduit means interconnecting the nozzle means and the outlet of the finish storage tank means, said nozzle means being adapted to receive finish from the outlet of the storage tank means and spray the finish onto the floor in front of the finish spreading means with regard to the direction of movement of the frame means in applying finish to the floor.

13. A floor finish applicator as claimed in claim 12 wherein said nozzle means include check valve means adapted to prevent dripping from the nozzle means when the spray means is deactuated.

14. A floor finish applicator as claimed in claim 12 wherein:

resilient biasing means are connected to said finish spreading means and are adpated to resiliently urge the finish spreading means to move in a first transverse direction with respect to the frame means; and manually actuatable linkage means are connected to the finish spreading means and are adapted, upon actuation, to move the finish spreading means in a transverse direction opposite to the direction of movement urged by the resilient biasing means.

15. A floor finish applicator as claimed in claim 1 and further comprising adjustable pressure means operably connected to the finish spreading means and adapted to apply downward pressure on the finish spreading means so as to control the distribution and thickness of the finish, said pressure means being adjustable to provide means for varying the thickness of finish desired.

16. A floor finish applicator as claimed in claim 15 wherein:

the frame means is rollably mounted on a pair of parallel wheels mounted in transverse alignment on opposite sides of the frame means; and the adjustable pressure means comprises a third wheel mounted on the frame means at a point forward of the parallel wheels, said third wheel being connected to the frame means by means of a lost motion mounting assembly comprising a resilient biasing means urging the third wheel downwardly and threaded adjustment means adapted to limit the downward movement of the third wheel at a preselected distance, said distance being adjustable as to vary the pressure on the finish spreading means.

17. A floor finish applicator comprising:

frame means mounted on wheels and adapted to be rolled in any selected direction along a floor, said frame means having handle means for pulling the frame means manually;

liquid finish storage tank means mounted on the frame means, said storage tank means comprising a closed pressurizable vessel having an inlet and outlet for liquid finish and an air pressure inlet, said storage tank means being adapted to hold liquid finish under pressure;

air pressure tank means mounted on the tank and adapted to hold pressurized air;

conduit means adapated to convey pressurized air from the air pressure tank means to the air pressure inlet of the storage tank means, said conduit means including valve means for regulating the air pressure in the storage tank means;

an elongated spreader frame positioned adjacent the floor behind the frame means, said spreader frame extending transversely with respect to the frame means;

a mop mounted on the underside of the spreader frame so as to be in contact with the floor;

spray nozzle means mounted on the spreader frame and adapted to spray liquid finish on the floor in front of the spreader frame in a predetermined manner, said nozzle means including check valve means adapted to prevent finish from dripping from the nozzle means after the applicator has been shut off;

conduit means adapted to convey liquid finish from the outlet of the storage tank means to the spray nozzle means, said conduit means including shut off valve means for controlling the spraying of liquid finish on the floor;

control means mounted on the frame means for selectively actuating the shut-off valve means so as to spray liquid finish on the floor;

mechanical linkage means pivotally connecting the spreader frame to the frame means for pivotal movement of the spreader frame about a vertical axis, said mechanical linkage means including linkage means adapted to hold the spreader frame in transverse alignment with the frame means as the spreader frame is moved pivotally with respect to the frame means;

manually operable lever arm means connected to the mechanical linkage for manually pivoting the spreader frame in either a clockwise or counterclockwise direction;

resilient biasing means adapted to urge the spreader frame in a one pivoted direction so that one end of the spreader frame is urged in a transverse direction away from the frame means; and a roller mounted on said one end of the spreader frame for rotation about a vertical axis, the roller being mounted such that the longitudinal position of the roller with respect to the end of the spreader frame is adjustable.

18. A floor finish applicator as claimed in claim 1 wherein the finish spreader includes a porous mop mounted on the underside of a transverse spreader frame, the spreader frame including openings therein that permit liquid finish to pass downwardly into the mop from the top of the frame, said finish spreading means applying liquid finish on the floor by dispensing liquid finish on the top of the mop, the liquid finish soaking into the mop and the mop in turn spreading the liquid finish on the floor.

19. A floor finish applicator as claimed in claim 18 wherein the spreader frame includes a receptacle for liquid finish extending over the top of the mop, with the receptacle being perforated to permit finish to drip downwardly into the mop, the finish applying means dispensing liquid finish to the receptacle by means of a hollow perforated outlet tube extending along the receptacle and mounted thereabove, a conduit means extending between the outlet of the storage tank and the interior of the outlet tube so as to convey liquid finish to the outlet tube.

20. A floor finish applicator as claimed in claim 19 wherein:

the perforations in the tray are formed adjacent the forward edge of the tray and the tray is sloped downwardly toward said openings so as to urge liquid finish to flow to said openings; and the mop is perforated so as to permit liquid finish to flow through the mop onto the floor.

21. A floor finish applicator as claimed in claim 1 wherein:

the finish spreading means is connected to the frame by means of a parallelogram linkage that maintains transverse alignment of the finish spreading means as finish spreading means is moved transversely with respect to the frame; and the parallelogram linkage is pivotably mounted to the frame so as to permit some vertical as well as transverse movement of the finish spreading means with respect to the frame, the vertical movability of the finish spreading means allowing the finish spreading means to ride evenly along the floor with uniform pressure on the floor even though the vertical position or angle of the frame may vary somewhat with respect to the finish spreading means.

22. A floor finish applicator as claimed in claim 21 wherein the frame rides on at least two parallel wheels aligned in a transverse direction and the frame is pivotable in a vertical direction about the axis of said wheels; and the vertical movability of the finish spreading means is sufficient to permit the finish spreading means to remain on the floor while there is some pivotal movement of the frame, but the movability is limited such that the finish spreading means can be lifted off the floor by pivoting the frame beyond a predetermined point.

23. A floor finish applicator as claimed in claim 22 and further comprising resilient biasing means extending between the frame and the mechanical linkage for the finish spreading means, said resilient biasing means urging the finish spreading means against the floor.

24. A floor finish applicator as claimed in claim 21 and further comprising resilient biasing means urging the finish spreading means to remain generally centered with respect to the frame, the finish spreading means being movable transversely by pivoting the frame about a vertical axis.

25. A floor finish applicator as claimed in claim 1 wherein the frame includes a handle for manually pulling the floor finish applicator across the floor, said handle being pivotably mounted to the frame so that the handle can be lowered or raised with respect to the frame, said handle including releasable locking means for locking the handle in a fixed pivotal position with respect to the frame.

* * * * *